US008905151B2

(12) United States Patent
Silva, Jr. et al.

(10) Patent No.: US 8,905,151 B2
(45) Date of Patent: Dec. 9, 2014

(54) EXTENDED COVERAGE PENDENT SPRINKLER

(75) Inventors: Manuel R. Silva, Jr., Cranston, RI (US); Donald B. Pounder, North Kingstown, RI (US); Michael R. Landi, Boston, MA (US)

(73) Assignee: Tyco Fire Products LP, Lansdale, PA (US)

( * ) Notice: Subject to any disclaimer, the term of this patent is extended or adjusted under 35 U.S.C. 154(b) by 1004 days.

(21) Appl. No.: 12/595,039

(22) PCT Filed: Apr. 21, 2008

(86) PCT No.: PCT/US2008/061057

§ 371 (c)(1),
(2), (4) Date: Feb. 4, 2010

(87) PCT Pub. No.: WO2008/131356

PCT Pub. Date: Oct. 30, 2008

(65) Prior Publication Data

US 2010/0132962 A1 Jun. 3, 2010

Related U.S. Application Data

(60) Provisional application No. 60/912,915, filed on Apr. 19, 2007, provisional application No. 60/974,380, filed on Sep. 21, 2007.

(51) Int. Cl.

| | |
|---|---|
| ***A62C 37/08*** | (2006.01) |
| ***A62C 31/22*** | (2006.01) |
| ***A62C 35/68*** | (2006.01) |
| ***A62C 37/12*** | (2006.01) |

(52) U.S. Cl.
CPC ..... *A62C 35/68* (2013.01); *A62C 37/12* (2013.01)
USPC ..... 169/38; 169/37; 169/41; 169/70

(58) Field of Classification Search
CPC ..... A62C 31/005; A62C 31/02; A62C 35/58; A62C 35/68; A62C 37/08
USPC ..... 169/5, 16, 37, 38, 39, 41, 42, 54, 70
See application file for complete search history.

(56) References Cited

U.S. PATENT DOCUMENTS 6,446,732 B1 9/2002 Polan
6,976,543 B1 * 12/2005 Fischer ..... 169/37

(Continued)

OTHER PUBLICATIONS

International Search Report and Written Opinion for PCT/US08/61057 ( 8 pages).

(Continued)

*Primary Examiner* — Ryan Reis
(74) *Attorney, Agent, or Firm* — Perkins Coie LLP

(57) ABSTRACT

An extended coverage pendent sprinkler configured for the fire protection of an occupancy classified as any one of: light hazard, ordinary hazard, extra hazard, rack storage with solid shelves and any combination thereof. The sprinkler preferably includes a body having an inlet and an outlet spaced from the inlet to define a passageway to further define a sprinkler axis and a K factor ranging from 11 gpm/(psi)$^{1/2}$ to about 25 gpm/(psi)$^{1/2}$. A deflector is spaced from the outlet to distribute a fire fighting fluid over a maximum protection area of about 196 square feet, and having one or more combination of features as described in the preferred deflector described herein.

30 Claims, 22 Drawing Sheets

(56) References Cited

U.S. PATENT DOCUMENTS

| | | | | |
|---|---|---|---|---|
| 7,201,234 | B2 * | 4/2007 | Rogers et al. | 169/37 |
| 7,584,802 | B1 | 9/2009 | Fischer | |
| 7,819,201 | B2 * | 10/2010 | Pounder et al. | 169/37 |
| 2005/0045739 | A1 * | 3/2005 | Multer | 239/209 |

OTHER PUBLICATIONS

Golinveaux, "What we don't know about storage", 2006 Fire Suppression and Detection Research Application Symposium (2006) Entire document, especially at p. 26, [retrieved on Oct. 7, 2009]. Retrieved from the Internet: <URL: www.nfpa.org/assets/files/PDF/Proceedings/What_We_Don't_Know_About_Storage-J. Golinveaux_presentation.pdf.

Tyco Fire & Building Products, Data Sheet TFP 215 entitled "Model EC-17—16.8 K-Factor Extended Coverage Area Density Sprinklers Pendent and Recessed Pendent", (Nov. 2007).

Tyco Fire Products Research and Development Center, "Application of the Tyco Fire Products: Extended Coverage Extra Hazard and High Piled Storage Sprinklers", (Sep. 2007).

National Fire Protection Association, NFPA 13 Standard for the Installation of Sprinkler Systems, 2007 Edition, p. 23 to p. 90.

Factory Mutual Approvals LLC, Approval Standard, Class No. 2000: Automatic Control Mode Sprinklers for Fire Protection, Mar. 2006.

Tyco Fire & Building Products, Data Sheet TFP 213 entitled "Model EC-25—Extended Coverage Area Density Sprinklers 25.2 K-Factor", (Sep. 2004).

* cited by examiner

EXTENDED COVERAGE PENDENT SPRINKLER

PRIORITY DATA AND INCORPORATION BY REFERENCE

This application is a 35 U.S.C. §371 application of International Application No. PCT/US2008/061057, filed Apr. 21, 2008, which claims the benefit of priority to U.S. Provisonal Patent Application No. 60/912,915, filed Apr. 19, 2007, and U.S. Provisional Patent Application No. 60/974,380, filed Sep. 21, 2007, each of which is incorporated by reference in its entirety. Also incorporated by reference in their entirety is TYCO FIRE & BUILDING PRODUCTS Data Sheet TFP 215 entitled "Model EC-17-16.8 K-Factor Extended Coverage Area Density Sprinklers Pendent and Recessed Pendent," (November 2007), and a document entitled, "Application of the Tyco Fire Products: Extended Coverage Extra Hazard and High Piled Storage Sprinklers" (September 2007) from TYCO FIRE PRODUCTS RESEARCH AND DEVELOPMENT CENTER, which shows and describes preferred applications of the Model EC-17 sprinkler disclosed in Data Sheet TFP 215.

TECHNICAL FIELD

This invention relates generally to sprinklers for fire protection. More specifically, the invention is directed to pendent type sprinklers that provide control mode extended coverage fire protection for a variety of classes of occupancies.

BACKGROUND OF THE INVENTION

The National Fire Protection Association (NFPA) promulgates standards relating to fire protection such as, for example, NFPA Standard 13 (2007) (hereinafter "NFPA-13 (2007)"), portions of which are incorporated in their entirety herein by reference. For example Chapter 8, Section 8.8 of NFPA-13 (2007), which is incorporated herein in its entirety is applicable to extended coverage upright and pendent spray sprinklers. This section provides that for extended coverage sprinklers the maximum allowable coverage for extra hazard is 196 square feet, which is applicable to densities of 0.25 gpm/sq. ft. and higher. To address this requirement, Tyco Fire & Building Products introduced an upright extended coverage sprinkler having a nominal K-factor of 25 (EC K-25). At its minimum operating pressure of 7 psi., and the maximum spacing of 196 sq. ft., the existing EC K-25 is applicable to densities of 0.36 gpm/sq. ft. and higher. While effectively addressing the needs for extended coverage, the average density of the sprinkler presents an overdischarge of fluid for areas requiring a design density less than 0.36 gpm/sq. ft.

NFPA provides other provisions which are applicable to extended coverage and/or control mode sprinklers and systems. Chapter 11 of NFPA-13 (2007), which is incorporated herein by reference is applicable to the design approaches in configuring a preferred sprinkler system. Chapter 12 of NFPA-13 (2007), which is incorporated herein by reference in its entirety is directed to the general requirements for storage. Section 14.2 of NFPA-13 (2007), which is incorporated herein by reference in its entirety is directed to control mode density-area sprinkler protection criteria for palletized, solid piled, bin box or shelf storage of Class I through Class IV Commodities. Section 15.2 of NFPA-13 (2007), which is incorporated herein by reference in its entirety is directed to control mode density-area sprinkler protection criteria for palletized, solid piled, bin box or shelf storage of Plastic and Rubber Commodities.

Other applicable standards include: Underwriter Laboratories, Inc. Specification UL 199, and Factory Mutual Approval Standard entitled, "Class Number 2000: Automatic Control Mode Sprinklers For Fire Protection" (March 2006).

DISCLOSURE OF INVENTION

A preferred embodiment of the invention provides for an extended coverage pendent sprinkler, preferably having a K-factor ranging from about 11 gpm/(psi)$^{1/2}$ to about 25 gpm/(psi)$^{1/2}$. The preferred sprinkler preferably provides an average density of 0.23 gpm/sq. ft. or higher for the maximum 196 square foot per sprinkler coverage area. The preferred sprinkler further preferably provides extended coverage protection for occupancies classified as greater than or more severe than ordinary hazard occupancies.

A preferred embodiment of the pendent sprinkler assembly has a proximal end and a distal end and includes a body having an inlet and an outlet spaced from the inlet to define a passageway to further define a sprinkler axis and a K factor ranging from about 11 gpm/(psi)$^{1/2}$ to about 25 gpm/(psi)$^{1/2}$. A pair of arms diametrically opposed about the body, so as to define a plane therebetween, extend distally and converge toward one another so to define an apex therebetween. A preferred deflector is distally spaced from the outlet and preferably includes a plate member defining a peripheral edge. The deflector has a first surface opposed the outlet of the body and preferably includes a pair of spaced apart projections. The deflector also includes a second surface parallel the first surface, and a central bore extending between the first and the second surfaces for engagement with a portion of the body.

The second surface of the deflector preferably has a central portion disposed in a first plane and a peripheral portion about the central portion disposed in a second plane angled relative the first plane. The angle between the first and the second plane is preferably about 6°. The second surface further preferably includes an intermediate portion disposed between the central portion and the peripheral portion in a third plane relative to the first plane. The angle between the third and the first is preferably about 13°.

The peripheral edge preferably has a portion defining a pair of substantially straight parallel portions disposed about the sprinkler axis extending in a direction perpendicular to the plane of the arms. The pair of substantially straight parallel portions define a spacing therebetween preferably ranging between about 1.5 to about 1.75 inches.

The peripheral edge further includes a plurality of slots, each slot including a first end and a second end spaced from the first end along a slot axis so as to define a slot length, wherein further at least a portion of the plurality of slots have the first end radially disposed between the central bore and the peripheral edge, the second ends of the portion of the plurality of slots being coterminous with the peripheral edge so as to define open ended slots, the open ended slots defining a first set in the plurality of slots. The plurality of slots further including a second set of slots, the first ends and the second ends of the second set of slots being disposed between the central bore and the peripheral edge to define closed ended slots. At least two of the second set of slots are disposed about the plane of the arms along a line extending substantially perpendicular to the plane. Each of the at least two of the second set of slots is preferably disposed between two slots of the first set of slots that are preferably substantially the same slot length and defining the smallest slot length of the deflector. The first set of slots further preferably define variable slot lengths such that the first ends of the first set of slots are radially disposed from the sprinkler axis at distance ranging from about 0.5 inches to about 0.40 inches.

In another aspect of the preferred embodiment, an extended coverage sprinkler is provided for protection of an occupancy having a classification greater than or more severe than ordinary hazard. The preferred embodiment being configured for installation so as to define a sprinkler spacing greater than fourteen feet (14 ft.). The preferred sprinkler further preferably defines an installation sprinkler spacing at a minimum of ten feet and a maximum greater than fourteen feet. In an alternate embodiment the preferred sprinkler spacing defines a maximum spacing of at least fifteen feet (15).

In yet another preferred embodiment, provided is an extended coverage pendent sprinkler assembly having a proximal end and a distal end, the sprinkler being configured for the fire protection of an occupancy classified as any one of: light hazard, ordinary hazard, extra hazard, rack storage with solid shelves and any combination thereof. The sprinkler preferably includes a body having an inlet and an outlet spaced from the inlet to define a passageway to further define a sprinkler axis and a K-factor ranging from about 11 gpm/(psi)$^{1/2}$ to about 25 gpm/(psi)$^{1/2}$. A deflector is distally spaced from the outlet to distribute a fire fighting fluid over a maximum protection area of about 196 square feet. The deflector is further preferably configured to throw the fluid perpendicular to the axis (radially) a minimum distance of about 9 feet such that the fluid travels no more than 3 feet in the distal direction parallel to the axis (vertically) at the nine foot minimum. The distribution performance of the sprinkler preferably occurs at a minimum operating pressure of about seven pounds per square inch (7 psi.). The deflector can be further configured to include one or more combination of features as described in the preferred deflector above and herein below.

BRIEF DESCRIPTIONS OF THE DRAWINGS

The accompanying drawings, which are incorporated herein and constitute part of this specification, illustrate exemplary embodiments of the invention, and, together with the general description given above and the detailed description given below, serve to explain the features of the invention.

Figure 5:
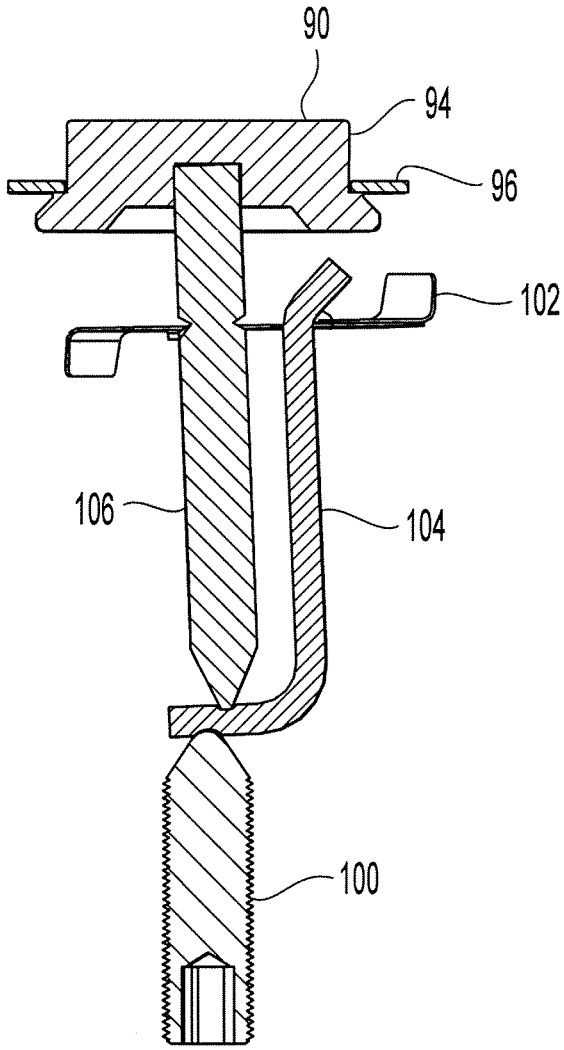
FIG. 5 is a cross-sectional view of preferred trigger and sealing assemblies for use in the sprinkler of FIGS. 1, 2, and 2A.
Figure 5A:
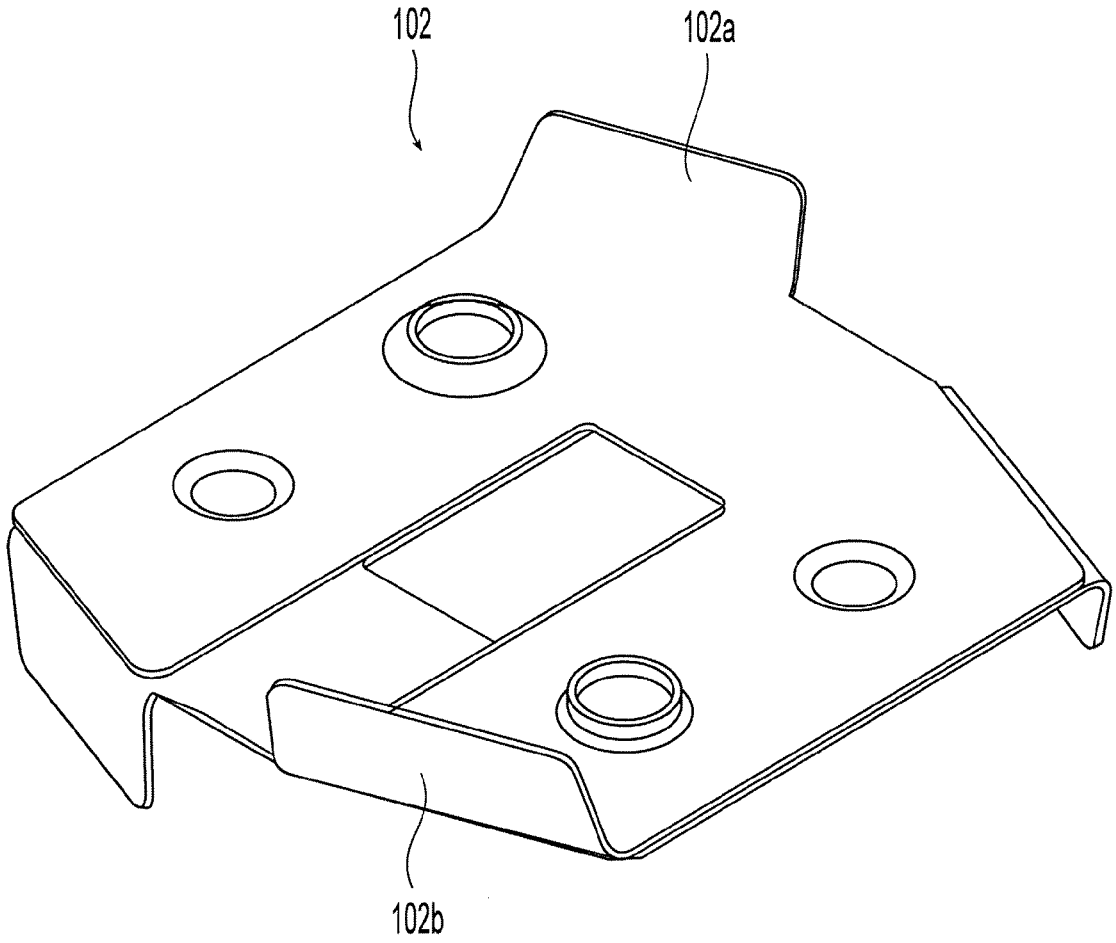

FIG. 5*a* is a preferred link assembly for use in the trigger assembly of FIG. 5.

Figure 1:
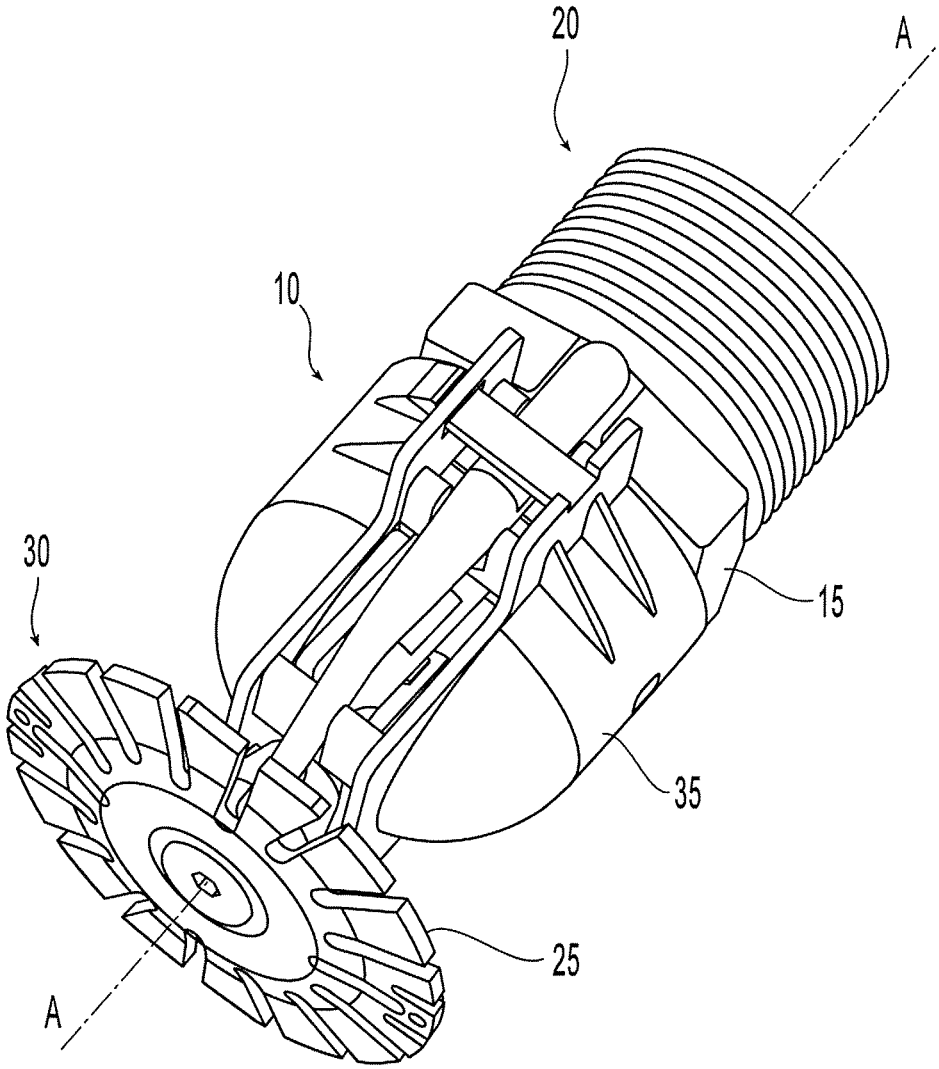
FIGS. 1, 2 and 2A are varying perspective views of a preferred sprinkler.
Figure 6:
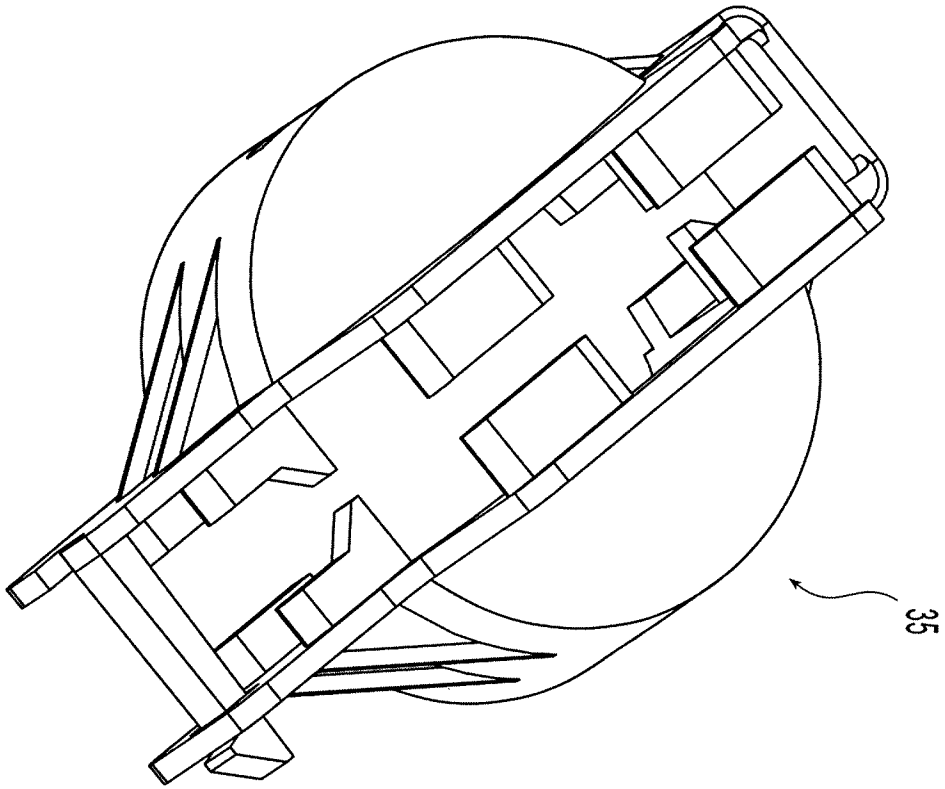
Figure 6A:
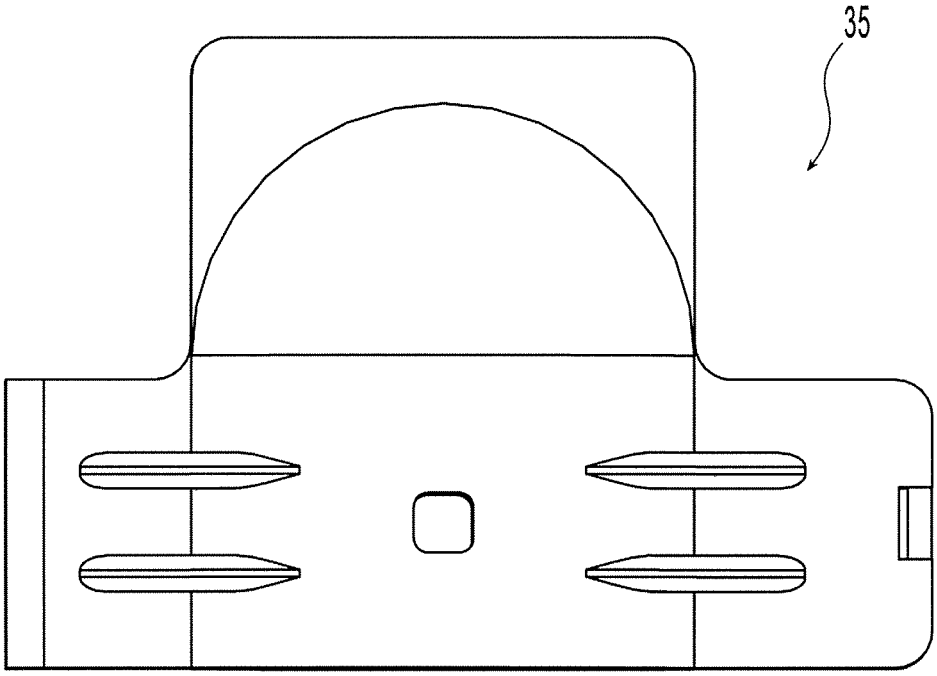
Figure 6B:
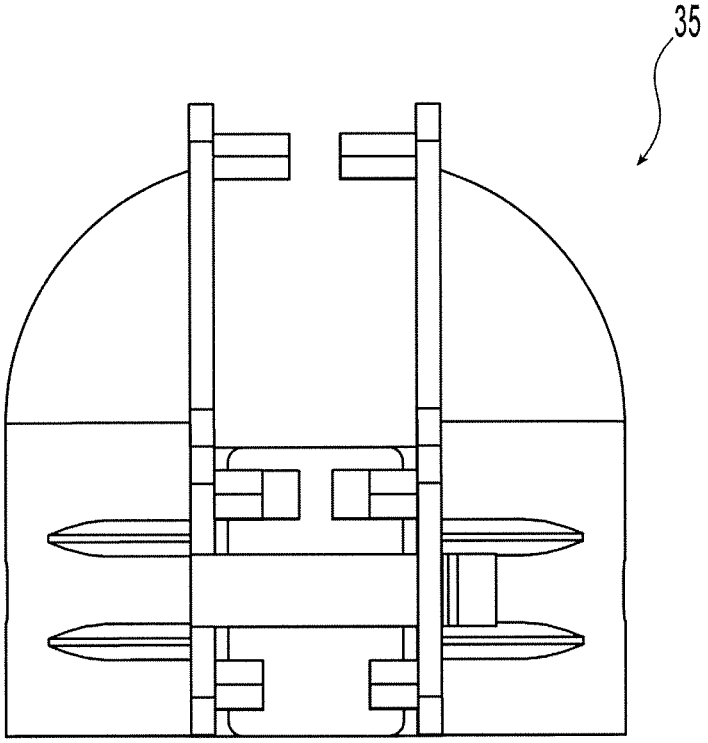
Figure 6C:
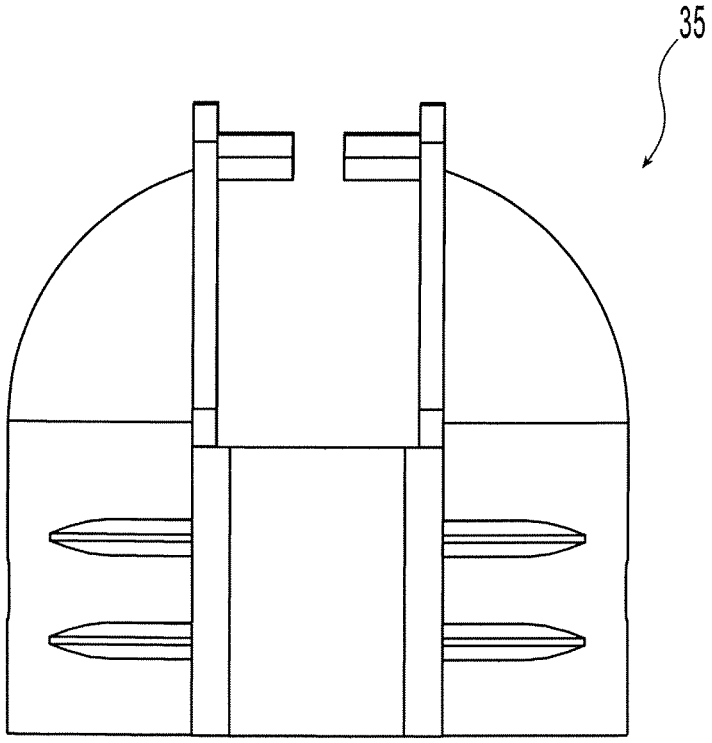
Figure 6D:
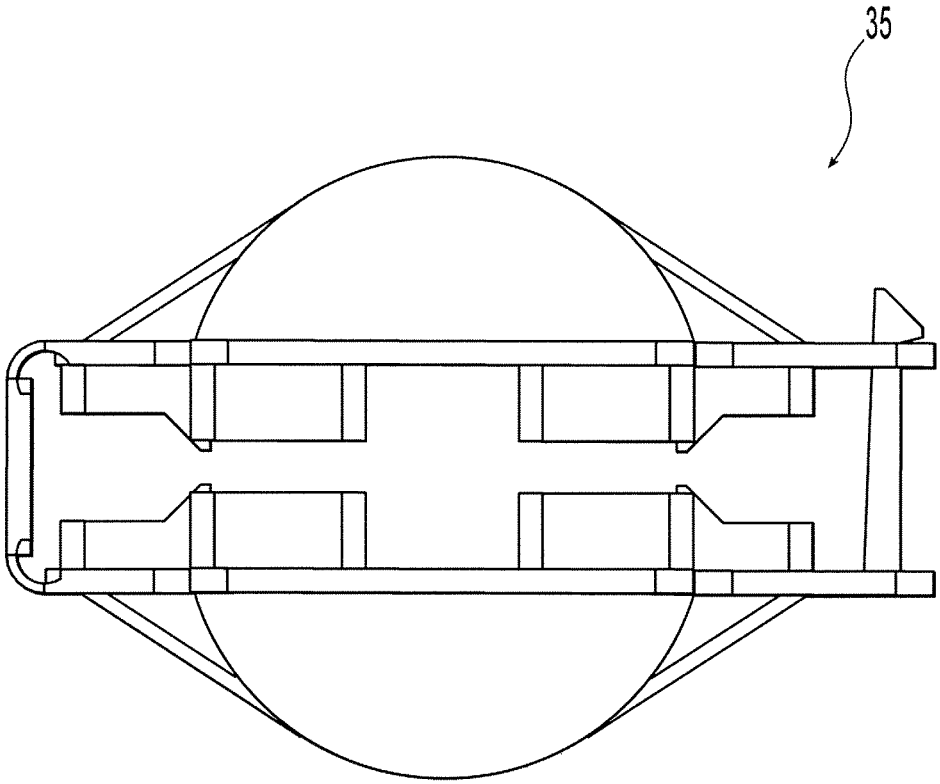
Figure 6E:
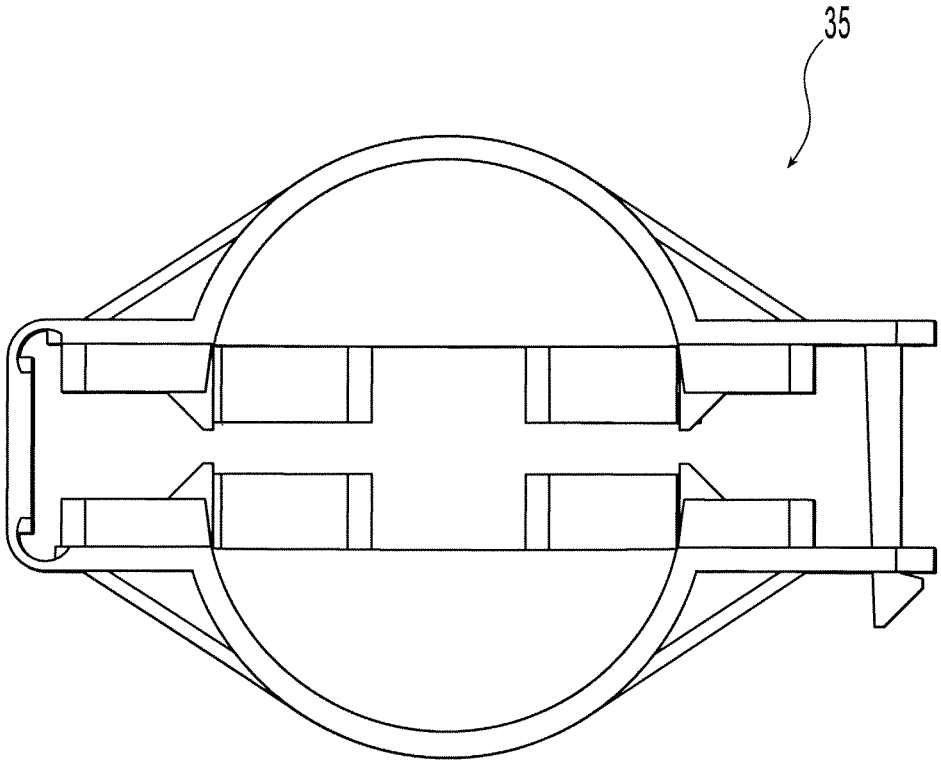

FIGS. 6-6E are varying views of the link protector in FIG. 1.

Figure 2:
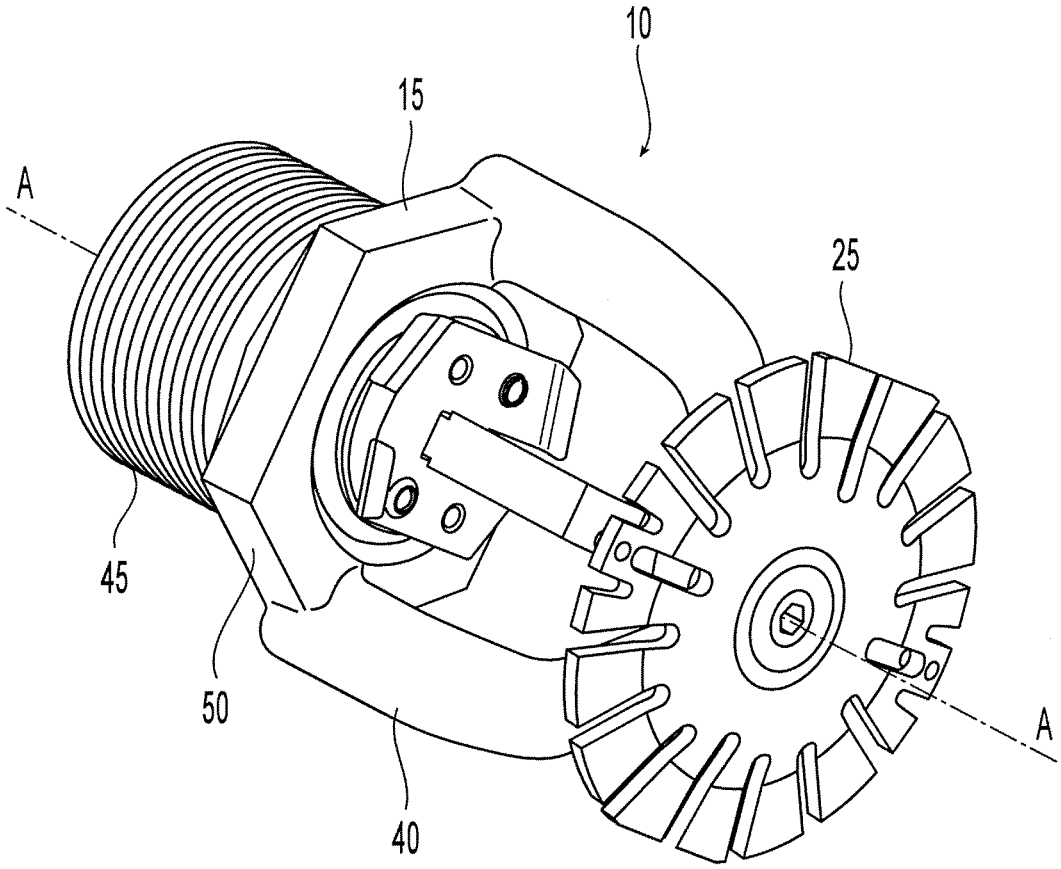
Figure 2A:
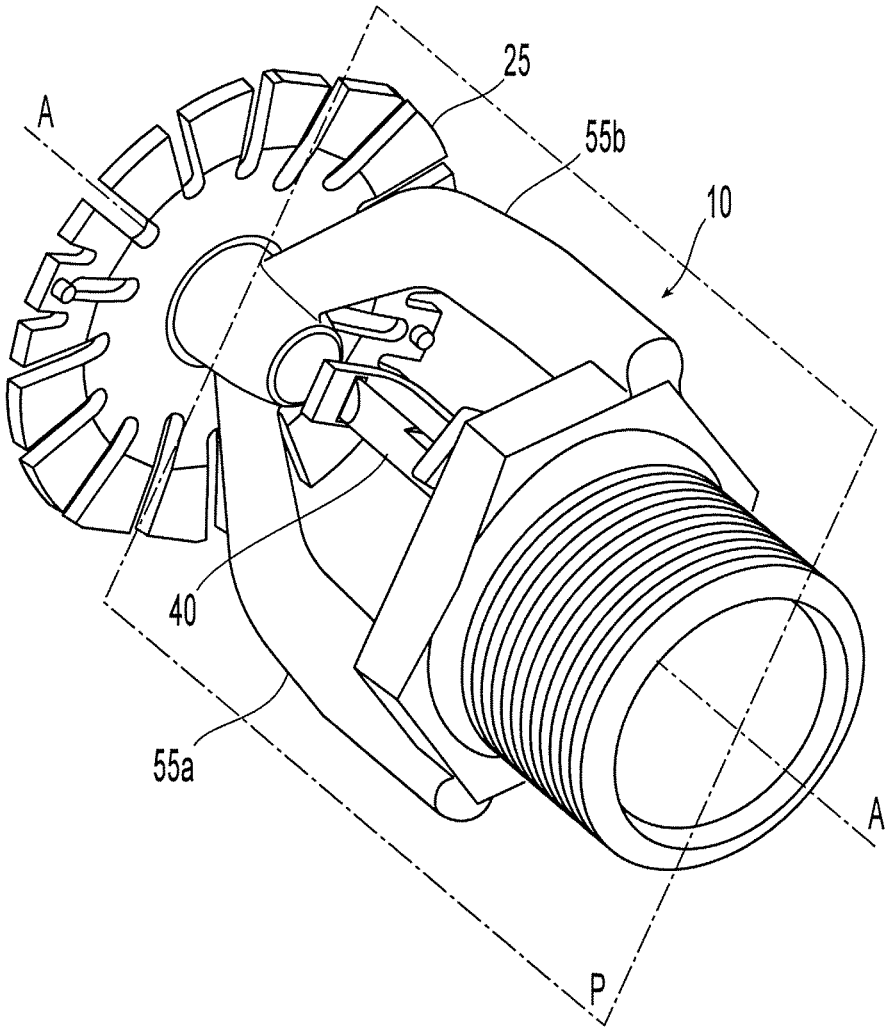
Figure 7:
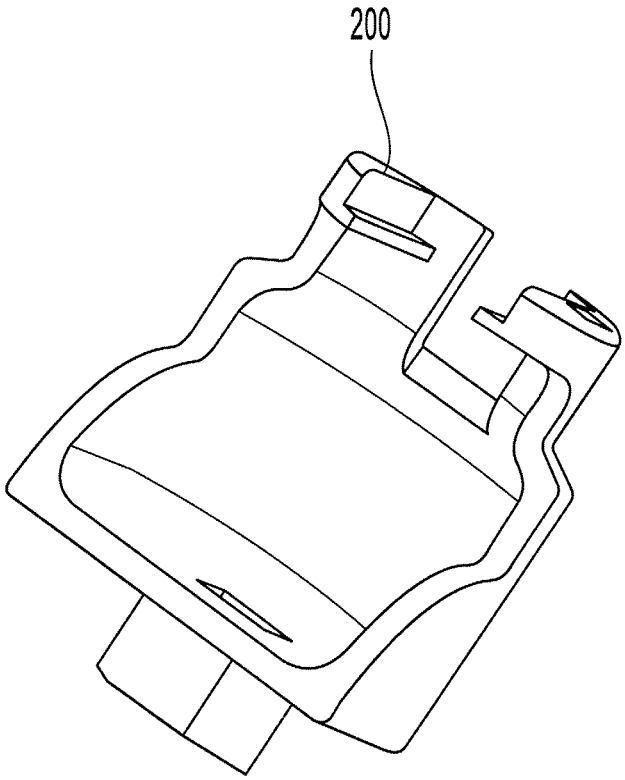

FIG. 7 is an isometric view of a preferred installation tool for installing the sprinkler of FIGS. 1, 2, and 2A.

MODE(S) FOR CARRYING OUT THE INVENTION

Shown in FIG. 1 is a illustrative embodiment of preferred sprinkler 10 configured to provide extended coverage fire protection for a variety of occupancy classifications and storage configurations. In particular, the sprinkler 10 is configured to provide extended coverage fire protection for light hazard, ordinary hazard, extra hazard occupancies, as defined in National Fire Protection Association, Inc. (NFPA) publication NFPA 13 Chapter 5 (2007), or combinations thereof. In addition, the preferred sprinkler provides for extended coverage fire protection for a variety of storage configurations including rack storage with solid shelves.

The preferred sprinkler 10 is preferably configured as a pendent-type sprinkler 10 having a body 15 defining a proximal end 20 and a deflector 25 defining a distal end 30 spaced from the proximal end 20 along a sprinkler axis A-A. The sprinkler 10 includes a trigger assembly disposed between the sprinkler body 15 and the deflector 25 to thermally actuate the sprinkler 10. To protect the trigger assembly prior to service such as during packaging, shipping, storage or installation of the sprinkler 10, the sprinkler 10 preferably includes a preferred trigger assembly or link protector 35. The link protector 35 is preferably disposed or removed about the trigger assembly by hinge operation to respectively secure to or release the protector 35 from body 15. Other views of the link protector 35 are shown in FIGS. 6A-6E.

Figure 2B:
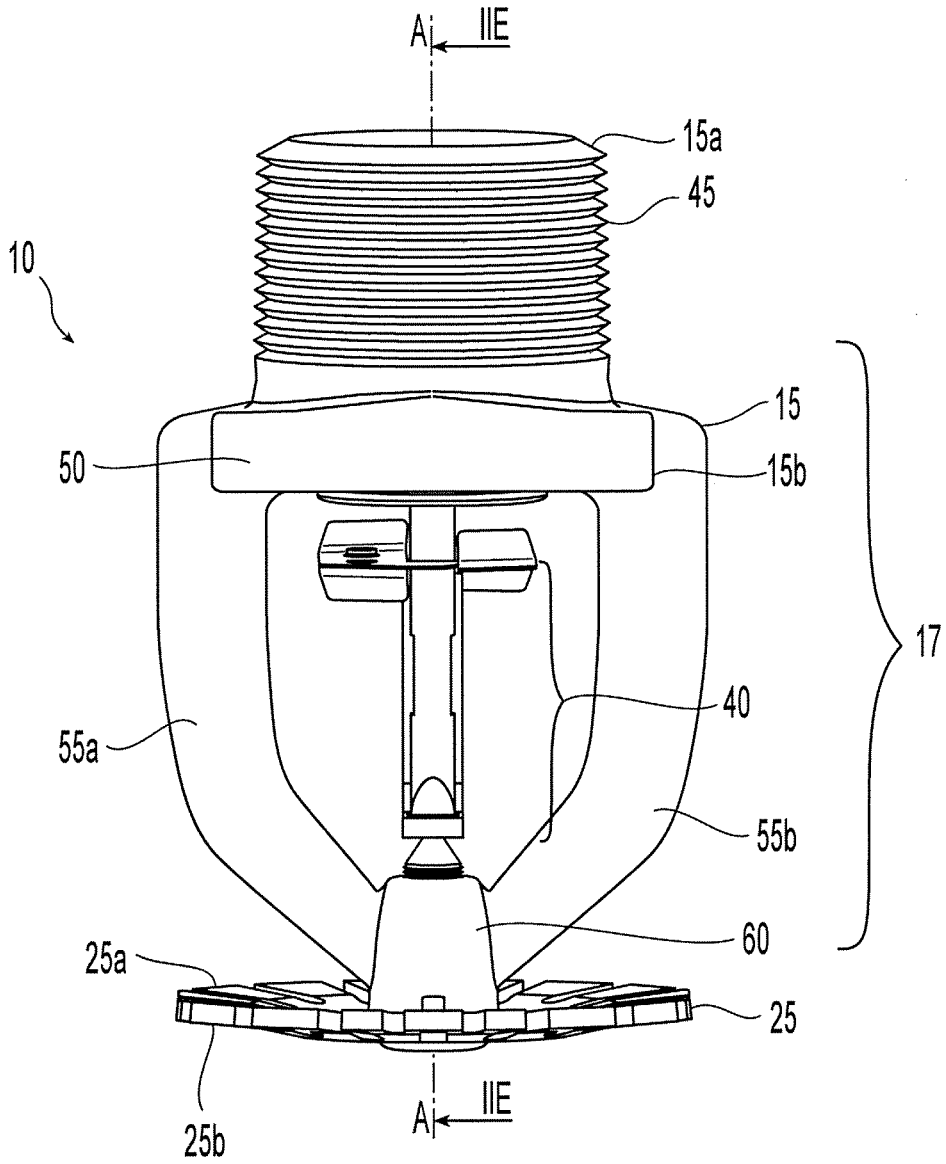
FIG. 2B is an elevation view of the sprinkler of FIGS. 1, 2, and 2A.

Shown in FIGS. 2, 2A, and 2B is the sprinkler 10 without the trigger assembly protector 35 disposed about the body 15 and the trigger assembly 40. The body 15 preferably includes at its proximal end 15*a* an outer thread 45 configure to install and secure the sprinkler 10 to a pipe branch, nipple or other pipe fitting of a fire protection system. The outer thread 45 is preferably configured as ¾-inch American National Standard Taper Pipe Thread (NPT). To facilitate installation of the sprinkler 10, the body 15 defines a tool engagement surface 50 preferably includes a series of flat surface defining a substantially hexagonal perimeter although other geometries are possible.

Figure 2C:
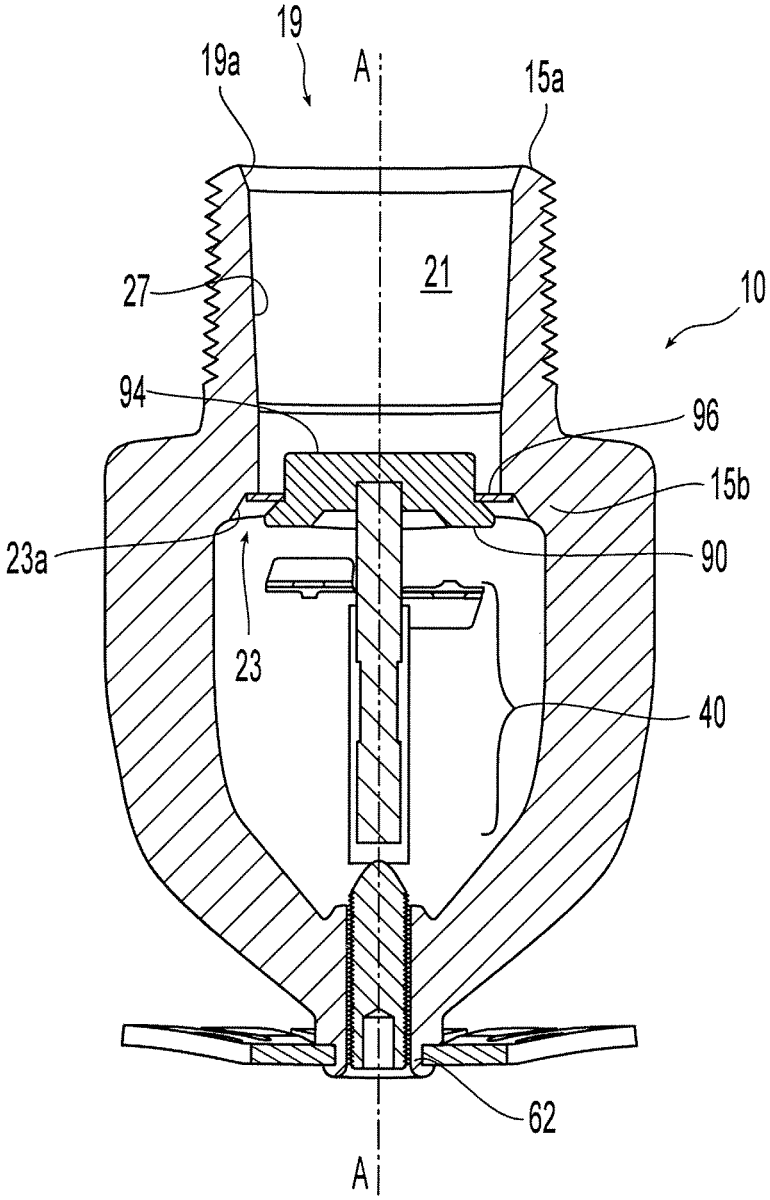
FIG. 2C is a cross-sectional view of the sprinkler of FIG. 2B.
Figure 2D:
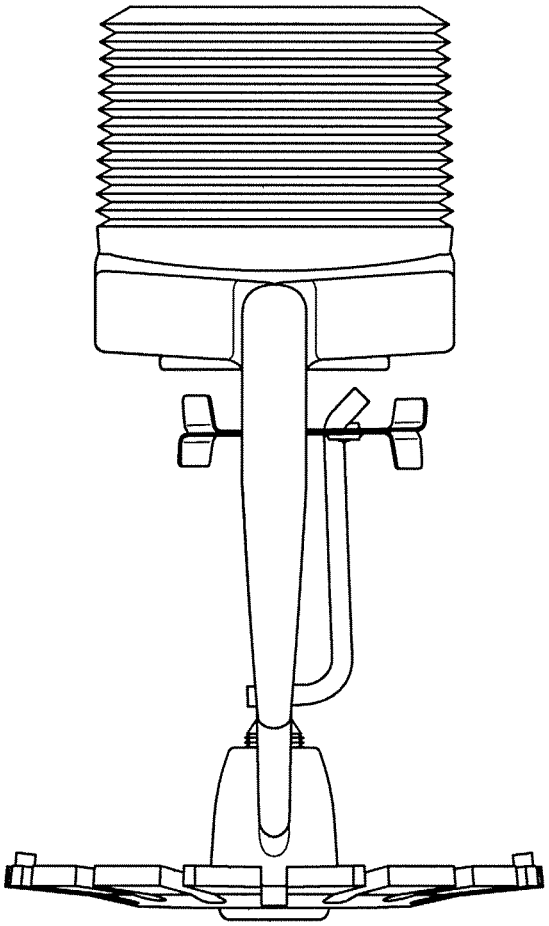
FIG. 2D is another elevation view of the sprinkler of FIGS. 1, 2, and 2A.
Figure 2E:
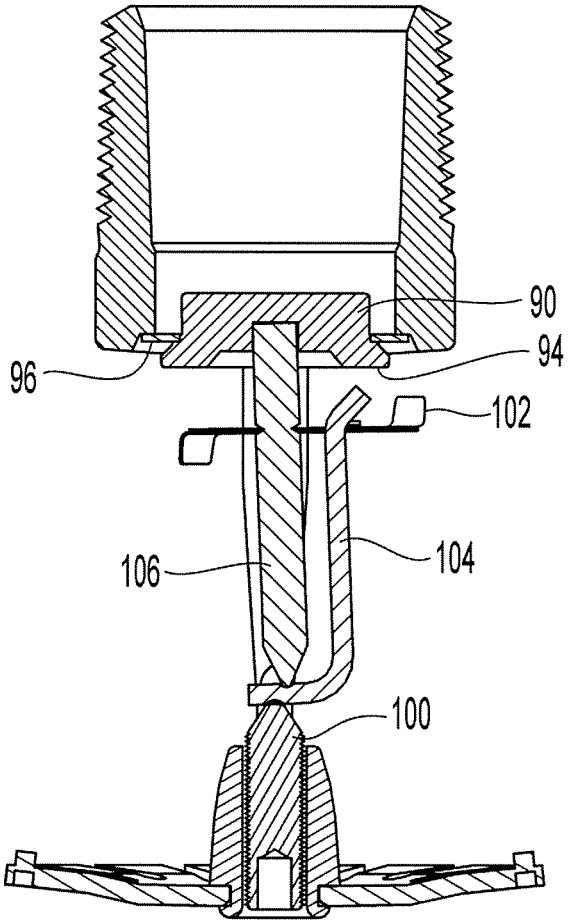
FIG. 2E is a sectioned view of the sprinkler of FIG. 2 along line IIE-IIE of FIG. 2B.

A cross-sectional view of the preferred sprinkler body 15 is shown, for example, in FIG. 2C. The proximal end 15*a* of the body further defines an inlet 19 defining a substantially conical entrance surface 19*a*. The distal end 15*b* of the body 15 defines an outlet 23 which preferably defines a conical outlet surface. Extending between the inlet 19 and the outlet 23 is a passageway 21 defined by the interior surface 27 of the body 15. The interior surface 27 of the body preferably tapers narrowly in the distal direction for a first portion and the further preferably defines a constant diameter for a second portion. The interior surface 27 further preferably defines a step transition to the outlet 23. The step transition provides a surface against which a button seal assembly rests to occlude the passageway.

A rated K-factor of a sprinkler provides a coefficient of discharge of the flow passage of the sprinkler and is defined as follow:

$$K - \text{factor} = \frac{Q}{\sqrt{p}}$$

where Q is the flow rate in GPM and p is the pressure in pounds per square inch gauge. The inlet 19, passageway 21 and outlet 23 of the sprinkler body preferably defines a K-factor ranging between 11 gpm/(psi)$^{1/2}$ and 25 gpm/(psi)$^{1/2}$, is preferably about 17 gpm/(psi)$^{1/2}$ and is more preferably about 16.8 gpm/(psi)$^{1/2}$.

Preferably depending from the distal end 15*b* of the sprinkler body 15 are a pair of spaced apart frame arms 55*a*, 55*b*. The frame arms 55*a*, 55*b* are preferably diametrically opposed about the sprinkler axis A-A and body 15 so as to define a plane P therebetween substantially bisecting the body 15. Each of the frame arms 55*a*, 55*b* further preferably tapers narrowly in the distal direction. In cross-section, each of the arms 55*a*, 55*b* is substantially oblong however other cross-sectional geometries are possible. The frame arms 55*a*, 55*b* extend distally defining a non-linear profile preferably converging toward an apex element 60.

Referring to FIGS. 2B and 2C, the apex element 60 can define a surface profile disposed about the sprinkler axis A-A that is curved, linear or a combination thereof. For example, the apex element can define a substantially frusto-conical surface which broadens in the distal direction toward the deflector 25. Alternatively, the apex element defines other geometries such as hemispherical or substantially pyramidal. At the distal end of the apex element 60 is a step transition defining a narrower substantially cylindrical portion or surface 62 for engagement with the deflector 25. The terminal end of the cylindrical portion or surface is preferably deformed to secure the deflector 15 over the cylindrical portion 62.

Collectively, the body 15, frame arms and apex element 60 form the frame assembly 17 of the sprinkler 10 having a frame window in which is disposed the trigger assembly 40. The frame assembly 17 may be cast as an integral assembly from a bronze alloy.

Figure 3:
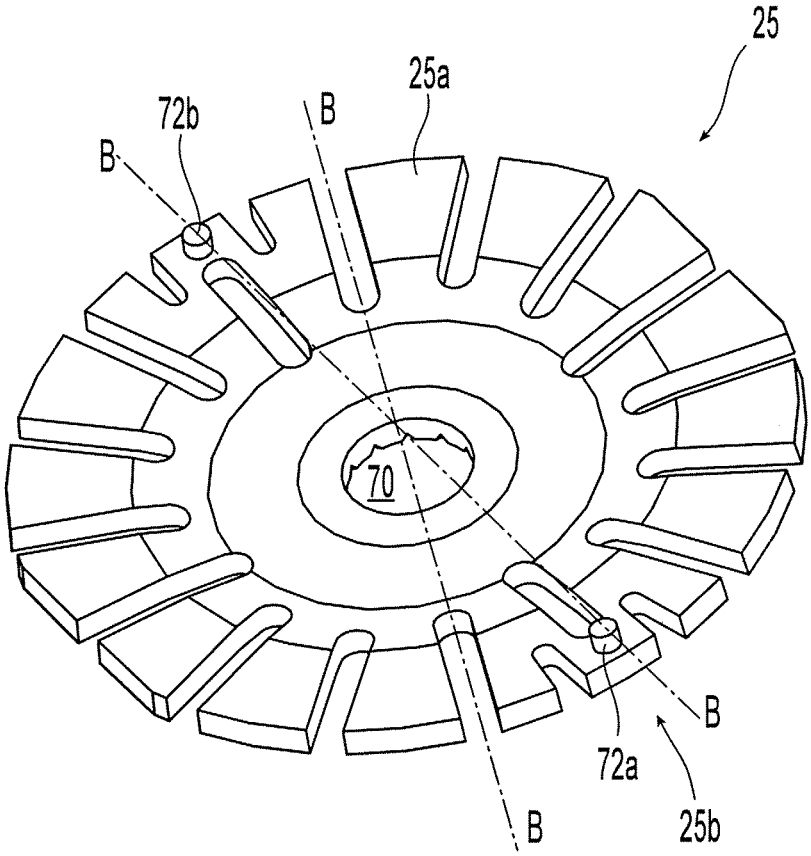
FIG. 3 is an isometric view of a deflector in the sprinkler of FIGS. 1, 2, and 2A.

The deflector 25 is preferably constructed from a substantially planar member or blank in which a plurality of slots and projections are formed. The blank is then further bent or punched to define a multi-planar profile for securement to the cylindrical portion 62 of the apex element 60. The deflector, as shown isometrically in FIG. 3, more specifically includes a proximal deflector surface 25*a* and a substantially parallel distal deflector surface 25*b*. The plurality of slots formed in the deflector 25 preferably extend from the proximal surface 25*a* through to the distal surface 25*b* to define tines of the deflector 25 between the individual slots. The deflector further includes a central bore 70 defining through which the cylindrical portion 62 of the apex element extends.

The proximal surface 25*a* of the deflector 10 preferably includes one or more dimples nubs or projections about which fluid traveling over the surface 25*a* of the deflector 25 may flow. More preferably, the deflector surface 25*a* includes a pair of dimples 72*a*, 72*b*. diametrically opposed about central bore 70. The dimples 72*a*, 72*b* are preferably substantially cylindrical in geometry having a diameter and height each ranging between about 0.05 inches to about 0.1 inches. More preferably, the dimples 72*a*, 72*b* have a diameter of about 0.06 and a height of about 0.05 inches. The dimples 72*a*, 72*b* are preferably similarly configured, and further preferably serve a substantially similar function, as the nubs shown and described in U.S. Pat. No. 7,201,234 entitled, "Residential Fire Sprinkler," which is incorporated herein in its entirety.

Figure 3A:
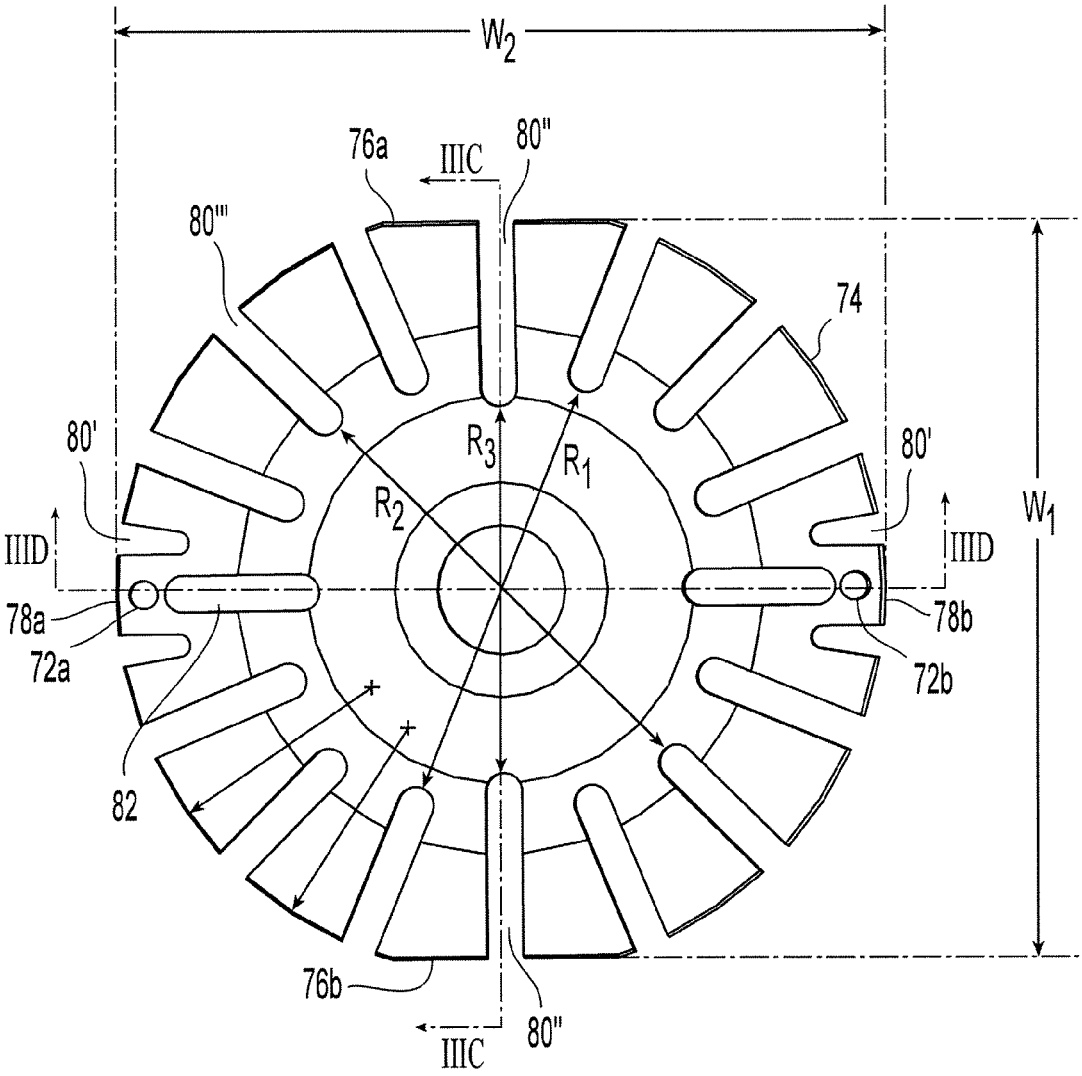
FIG. 3A is a plan view of the deflector of FIG. 3.

The deflector defines a peripheral edge 74, as seen in for example, the plan view of the deflector 25 in FIG. 3A. The peripheral edge 74 of the deflector 25 is preferably configured such that deflector is substantially symmetrical about a first deflector axis IIIC-IIIC and second deflector axis IIID-IIID. The peripheral edge is further preferably configured such that the deflector 25 is elongated in the direction in one axis and substantially truncated in the direction of the other axis. More specifically, the peripheral edge 74 defines a pair of parallel edges 76*a*, 76*b* that extend for a length in a direction perpendicular to the first deflector axis IIIC-IIIC. The pair of a parallel edges 76*a*, 76*b* are further preferably spaced apart along the first deflector axis IIIC-IIC so as to truncate the axis along the first deflector axis IIIC-IIIC. Preferred parallel edges 76*a*, 76*b* define a spacing $W_1$ therebetween ranging between about 1.5 inches to about 1.7 inches and is preferably about 1.625 inches.

Comparatively, the deflector 25 is preferably elongated in the direction along the second axis IIID-IIID. The peripheral edge 74 may further include another pair of parallel edges 78*a*, 78*b* that extend for a length in a direction perpendicular to the second axis IIID-IIID. Alternatively, the edges 78*a*, 78*b* may each be reduced to a point of intersection between the peripheral edge 74 and the second axis IIID-IIID. The parallel points or edges 78*a*, 78*b* provides for or defines a maximum spacing $W_2$ therebetween ranging between about 1.66 inches to about 1.7 inches and is preferably about 1.69 inches. More preferably, the dimples 72*a*, 72*b* are radially inside the parallel points or edges 78*a*, 78*b* located along the second axis IIID-IIID having a spacing therebetween ranging from about 1.55 inches to about 1.60 and is preferably 1.59 inches. A portion of the peripheral edge 74 that includes the point 78*a*, 78*b* preferably defines an arc length of a constant radius of curvature from a center point preferably disposed along the second deflector axis IIID-IIID and radially spaced from the center point of the deflector at about 0.5 inches and more preferably about 0.48 inches.

Figure 3B:
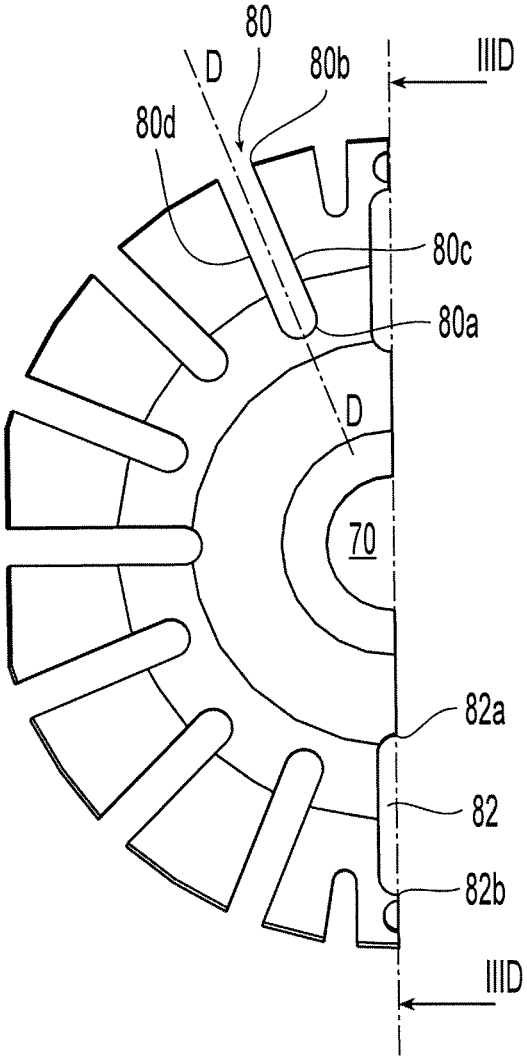
FIG. 3B is sectioned view of the deflector of FIG. 3.

Referring to the detailed view of FIG. 3B, each slot 80 of the plurality of slots of the deflector 25 include a first slot end 80*a* and a second slot end 80*b* spaced from the first end along a slot axis D-D so as to define a slot length. At least a portion of the plurality of slots 80 have the first slot end 80*a* radially disposed between the central bore 70 and the peripheral edge 74. The slots preferably provide that the second slot end 80*b* is coterminous with the peripheral edge 74 so as to define open ended slots. The plurality of slots of the deflector 25, preferably include another portion of slots 82 in which the first slot end 82*a* and the second slot end 82*b* are disposed between the central bore and the peripheral edge to define closed ended slots. Preferably, two closed ended slots are disposed along the second deflector axis IIID-IIID radially interior to the two dimples 72*a*, 72*b*. Each of the closed ended slots preferably define the same slot length.

Each slot of the deflector 25 preferably includes a pair of spaced apart walls disposed about the slot axes extending between the first end and the second end of the slots to define a slot width therebetween. Preferably, a portion of the slots of the deflector 25 have the same slot width. The slot widths for the deflector 25 preferably range between about 0.05 inches to about 0.1 inches and is preferably about 0.8 inches. The slot width for an individual slot is preferably constant, or alternatively tapers narrowly radially inward in the direction of the slot axis.

Preferably each open ended slot defines one of a pair of diametrically opposed slots. The varying diametrically open ended slots are preferably symmetrically disposed about the first and second deflector axes IIIC-IIIC, IIID-IIID. Preferably the slot axes define a radial spacing of about 23° therebetween and more preferably define an angular spacing of about 22.5 degrees. The plurality or group of open ended slots define a variety of open ended slot lengths for the deflector 25 including: slots 80' defining a minimum slot length, slots 80" defining a maximum slot length and preferably at least one open ended slot 80''' defining an intermediate slot length for the deflector. Accordingly, each of the various diametrically opposed open ended slot pairs define a radial spacing therebetween. The radial spacing between diametrically opposed slots, measured between respective first slot ends 80*a* preferably variably ranges between about 0.75 inches to about 1.00 inches and is preferably any one of R1=0.8 inches, R2=0.9 inches and R3=1.0 inches. In one preferred embodiment of the deflector 25, a pair of open ended minimum length slots 80' are preferably disposed about a dimple 72 and a pair of diametrically opposed open ended maximum slot length is disposed along the first deflector axis IIIC-IIIC.

The orthogonal axes IIIC-IIIC, IIID-IIID define a quarter of the deflector therebetween. Preferably, the quarter of the deflector includes a portion of the peripheral edge defining a curved profile having one or more radii of curvature. Preferably, a quarter of the deflector defines a radius of curvature having a center point located at a distance of about 0.192 inches from the second slot axis IIID-IIID of the first pair of diametrically opposed slot axes and about 0.261 inches from the first slot axis IIIC-IIIC. The quarter of the deflector further preferably includes a second radius of curvature having a center point located at a distance of about 0.261 inches from the second slot axis IIID-IIID of the first pair of diametrically opposed slot axes and about 0.192 inches from the first slot axis IIIC-IIIC.

Figure 3C:
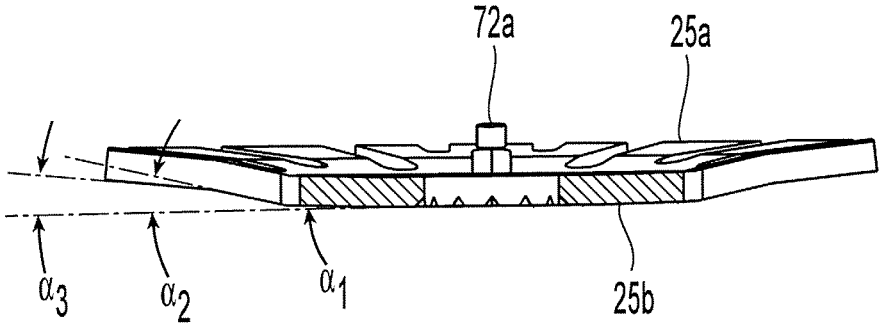
FIGS. 3C and 3D are varying cross-sectional views of the deflector of FIG. 3A along respective lines IIIC-IIIC and IIID-IIID.
Figure 3D:
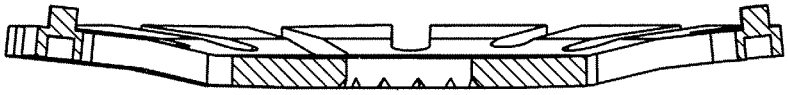

As noted above, the deflector 25 defines a profile in cross-section, as seen in FIGS. 3C and 3D, having various facets or portions in varying planes angled relative to one another. Preferably, the distal surface 25*b* of the deflector 25 define a centralized portion and a first angled surface relative to the centralized portion defining a relative angle therebetween of $\alpha$1 of about 1.5 degree. A peripheral angled surface relative to the central portion preferably defines an angle $\alpha$3 of about 6°, and an intermediate angled surface defines a third angle $\alpha$3 relative to the central portion of about 12.5°.

The deflector 25 defines a preferred orientation relative to the deflector arms 55*a*, 55*b* when secured to the cylindrical portion 62 of the apex 60. Specifically, the second deflector axis IIID-IIID is aligned perpendicular to the plane P defined by the arms 55*a*, 55*b*. Moreover, the preferred orientation aligns the substantially straight parallel edges 76*a*, 76*b* of the peripheral edge 74 adjacent the frame arms in a direction orthogonal to the plane P.

Figure 4:
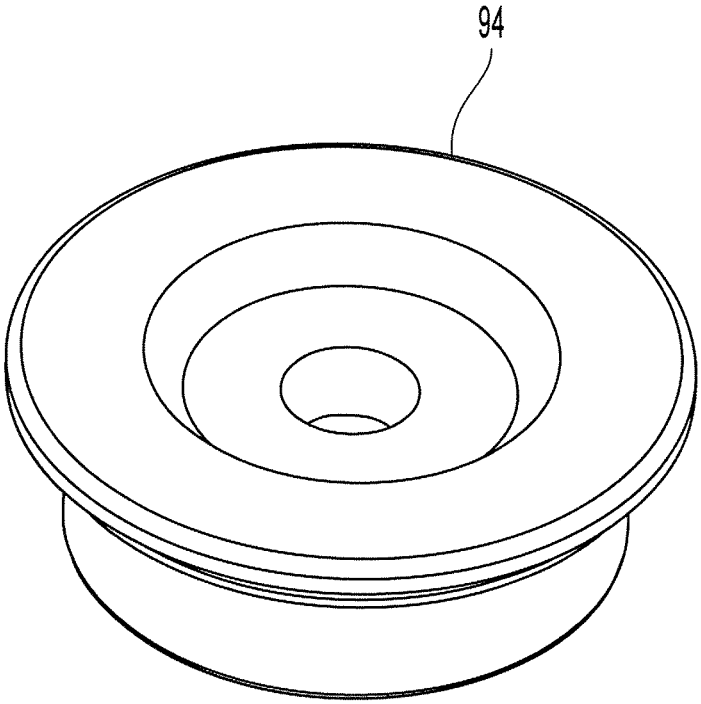
FIG. 4 is a preferred button for use in the sealing assembly of the sprinkler in FIGS. 1, 2, and 2A.
Figure 4A:
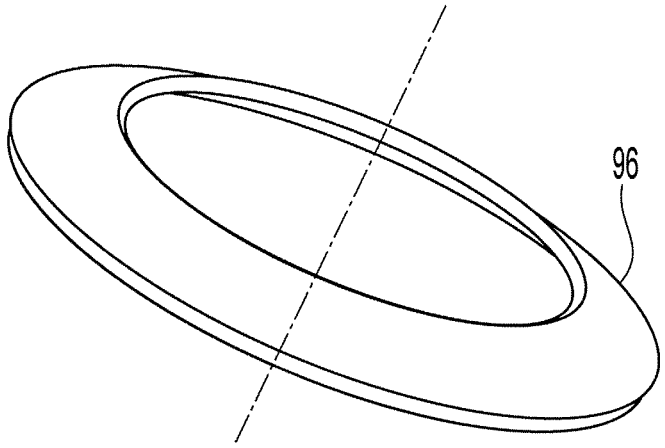
FIG. 4A is a preferred seal spring for use in the sealing assembly of the sprinkler in FIGS. 1, 2, and 2A.

As noted above, a button seal assembly 90 is supported against the outlet surface 23*a* of the sprinkler body 15 to occlude the fluid passageway 21. The button seal assembly 90 preferably includes a substantially cylindrical member or button 94, as seen in FIG. 4. Disposed about the button 94 is a spring seal 96, as seen in FIG. 4A. In an uncompressed state, the spring seal 96 preferably defines a substantially frusto-conical annular ring and a flat ring in a compressed state. The spring seal 96 is preferably rated with a minimum load of 145 lbs. to flatten the spring seal 96.

As noted above the button seal assembly 90 is preferably supported in the outlet 23 by the thermally sensitive trigger assembly 40. Referring to FIGS. 2C-2E and FIG. 5, the preferred trigger assembly 40 is preferably configured with a thermal rating of 160° F. or alternatively with a thermal rating of 212° F. The trigger assembly 40 further preferably includes a fusible link assembly 102 having two link halves 102*a*, 102*b* that are joined together by a thin layer of solder. A compression screw 100 drives the assembly proximally and compresses or flattens the spring seal 96 against the step transition surface of the outlet 23 in the body 15. When the rated temperature of the assembly is reached, the solder melts and the two link halves separate allowing the sprinkler 10 to activate and flow fluid. Separation of the link 102 allows rotation of the hook 104 which in turn rotates the strut member 106. The strut member 106 is disposed in a recess formed in the button 94. Accordingly, rotation of the strut member 106 imparts rotation upon the button 94 thereby eliminating the need for an ejector spring. Elimination of a known ejector spring from the trigger assembly preferably provides a more readily faster and efficient assembly of the sprinkler 10.

To further ensure that the sealing button 94 is deflected out of the fluid passageway upon sprinkler activation, the sealing button defines a preferred geometry that will increase rotation upon impact with water. In particular the preferred button defines a height to a minimum width ratio of about 0.2. The low height to width ratio facilitates rotation of the button upon rotation of the strut 106 and further prevents a deflection surface that is orthogonal to the incoming flow of fluid. Accordingly the preferred ejection of the sealing members minimizes or eliminates the possibility of the button 94 jamming within the frame arms upon sprinkler operation.

In operation and upon thermal actuation of the sprinkler 10, the trigger assembly separates from the frame assembly 17 to release the button 94 and sealing spring 96. Water supplied to the inlet 19 at the preferred operating pressure is released to flow through the passageway 21 and discharged from the outlet 23 of the body 15. The discharging fluid impacts the apex element 60, deflects off the proximal surface 25*a* of the deflector 25, flows around the dimples 72 and through the slots of the deflector 25 for distribution over a coverage area to provide preferably control mode extended coverage fire protection.

The preferred sprinkler 10 provides a sprinkler having a K-factor ranging between 11.2 gpm/(psi)$^{1/2}$ and 25 gpm/(psi)$^{1/2}$, preferably a K-factor of about 17 gpm/(psi)$^{1/2}$ and more preferably a K-factor of about 16.8 gpm/(psi)$^{1/2}$ for extended coverage fire protection for a variety of occupancy classifications including: light hazard, ordinary hazard, extra hazard occupancies or any combination thereof as defined in Chapter 5 of National Fire Protection Association, Inc. publication NFPA-13 (2007), which is incorporated herein by reference in its entirety. Additionally, the preferred sprinkler 10 provides extended coverage fire protection for various storage configurations including rack storage having solid shelves, high piled storage and other storage configurations. Furthermore, the preferred sprinkler 10 are preferably incorporated into a fire protection sprinkler system to provide control-mode extended coverage fire protection.

As an extended coverage sprinkler, the preferred sprinkler 10 preferably provides a maximum coverage area of 196 square feet (196 sq. ft.) at a maximum sprinkler-to-sprinkler spacing of about 14 feet. Comparatively, the preferred sprinkler 10 provides double the coverage area of standard sprinklers used in the similar applications. Accordingly, the preferred sprinkler 10 provides means for decreasing the number of required sprinklers to protect a given occupancy. The preferred sprinkler 10 further provides a maximum coverage area of 144 square feet (144 sq. ft.) at a maximum sprinkler-to-sprinkler spacing of about 15 feet. Such coverage and spacing provides in a retrofit of an existing system with a 144 square foot coverage area at a higher density for the 15 foot sprinkler-to-sprinkler spacing. Alternatively, the sprinkler 10 provides for a minimum sprinkler-to-sprinkler distance about 8 feet.

As a preferred extended coverage sprinkler, the sprinkler is preferably installed in a fire protection sprinkler system in accordance with the installation requirements of Chapter 8, Section 8.8 entitled, "Extended Coverage Upright and Pendent Spray Sprinklers" of NFPA-13 (2007) which is incorporated herein in its entirety. Accordingly, the preferred sprinkler 10 provides protection in noncombustible obstructed construction suitable for use within truss or bar joists having noncombustible web members greater than 1 inch when applying 4 times obstruction criteria rule defined under "Obstructions to Sprinkler Discharge Pattern Development." To facilitate installation of the sprinkler a preferred tool 200 may be used which is shown in FIG. 7. The tool 200 defines a chamber or housing with which to engage a sprinkler. Depending from the bottom of the tool 200 is a preferably a hexagonal tool engagement surface for engagement with an extension element or other tool such as, for example, a wrench.

The preferred sprinkler is preferably installed along a fluid supply line to place the sprinkler 10 in communication with a fluid source such as water or other fire fighting fluid. Fluid is preferably provided at a minimum pressure of about 7 psi. When incorporated within a fire protection system for storage, the sprinkler 10 and its deflector geometry preferably define a minimum deflector to storage clearance of about three feet (3 ft.). The minimum operating pressure 7 psi, coupled with the deflector 25 geometry of sprinkler 10, preferably optimizes sprinkler performance for maximum water throw at the minimum three foot (3 ft.) deflector to storage clearance. Moreover, the preferred deflector geometry prevents over throw of the coverage area at higher pressure and flows so as to provide consistent and substantially uniform distribution patterns for the applicable range of pressures and flows.

In addition, the preferred deflector geometry provides for a fluid or spray distribution pattern that is somewhat weaker in the central portion of the spray pattern. It has been shown in a full scale fire test that the weaker central spray portion provided by the preferred sprinkler 10 addresses a fire in a manner that allows the heat release to activate additional surrounding sprinklers to more effectively control the fire.

Other performance features in one preferred embodiment of the sprinkler 10 are believe to be provided by the geometry of the deflector 25. In particular, the angles of the deflector provide for a spray pattern in which water or other fire fighting fluids is distributed or thrown at least nine feet (9 ft) and more preferably more than nine feet (9 ft.) in a horizontal or radial direction off the deflector. Moreover, the deflector 25 and its angles preferably throw the water or other fluid such that fluid travels no more than three feet (3 ft.) in the vertical direction distally of the deflector at the minimum nine foot radial distance. The preferred distribution maintains a desired coverage area for the sprinkler 10 when subjected to the three foot minimum deflector-to-storage clearance.

The combination of bends and angles in the deflector 25 also prevents significant overthrow at high flow rates. In addition, the variable lengths of the slots in the deflector 25 provide for uniform horizontal surface discharge. Moreover, the truncation of the deflector in line and orthogonal to the frame arms allows the sprinkler to develop a spray pattern that is substantially rectangular as opposed to a more conventional type circular spray pattern. The substantially rectangular spray pattern provides an optimal distribution for a rectangular coverage area wherein the preferred minimum radial throw distance of nine feet occurs at the corners of the rectangular coverage area. In addition, the preferred spray pattern prevents or otherwise minimizes the overthrow into adjacent coverage areas.

Accordingly, the inventors, have provided an extended coverage pendent type sprinkler for installation in accordance with NFPA-13 (2007) Chapters 8 and 11 to provide extended coverage fire protection for a variety of classifications of occupancies and storages including extra hazard, high pile storage and rack storage with solid shelves that is hydraulically and/structurally advantageous over systems configured with either known extended coverage K-factor 25 (K-25) upright sprinklers or known standard spray sprinklers. In particular, the preferred lower nominal K-factor 17 (K-17) control mode extended coverage pendent type sprinkler 10 may provide an average density for a maximum coverage area of 196 square feet that is preferably 0.25 gpm/sq. ft. or higher and even more preferably 0.23 gpm/sq. ft or higher. Thus, the preferred sprinkler 10 avoids or otherwise minimizes any over discharge of water or fluid when compared to the use of the extended coverage K-factor 25 (K-25) sprinkler. Furthermore systems constructed with the preferred sprinkler 10 may provide for a reduction in the number of required sprinklers as compared to the standard spray sprinkler used in the same application.

Structurally, the preferred pendent configuration of the sprinkler 10 allows for its use in retail areas having finished ceilings which would otherwise be prohibited when using K-25 upright sprinklers. One preferred embodiment of the sprinkler 10 is described in TYCO FIRE & BUILDING PRODUCTS Data Sheet TFP 215 entitled "Model EC-17-16.8 K-Factor Extended Coverage Area Density Sprinklers Pendent and Recessed Pendent" (November 2007) which is incorporated herein in its entirety.

One particular application of the preferred sprinkler 10 is as a sprinkler for the protection of light and ordinary hazard occupancies where the floor to ceiling clearances ranging from about thirty-six feet to about 65 feet or more. Such occupancies can include buildings with high-roofs and non-storage occupancies such as atria, convention centers, casino auditoriums, theatres, and exhibition halls. In such an application, a plurality of sprinklers 10 are installed at a sprinkler to sprinkler spacing of about twenty feet (20 ft.) at a height ranging from about sixty to about sixty-five feet (60-65 ft.).

While the present invention has been disclosed with reference to certain preferred embodiments, numerous modifications, alterations, and changes to the described embodiments are possible without departing from the sphere and scope of the present invention, as described herein. Accordingly, it is intended that the present invention not be limited to the described embodiments, but that it have the full scope defined by the language of the following claims, and equivalents thereof.

What we claim is:

1. An extended coverage pendent sprinkler assembly having a proximal end and a distal end, the sprinkler being configured for the fire protection of an occupancy classified as any one of: light hazard, ordinary hazard, extra hazard, rack storage with solid shelves and any combination thereof, the sprinkler comprising:

a body having an inlet and an outlet spaced from the inlet to define a passageway to further define a sprinkler axis and a K factor of about 11 to 25 gpm/(psi)$^{1/2}$;

a deflector distally spaced from the outlet to distribute a fire fighting fluid over a maximum protection area of about 196 square feet so as to provide an average density as low as 0.23 gallons per minute per square foot (gpm/ sq. ft.), the deflector defining a plurality of tines disposed substantially perpendicular to the sprinkler axis;

wherein the deflector defines a peripheral edge and includes a plurality of slots, a portion of the peripheral edge defining a pair of substantially straight parallel portions disposed about the sprinkler axis; and the plurality of slots including slots being disposed between the sprinkler axis and the peripheral edge to define closed ended slots.

2. An extended coverage pendent sprinkler assembly having a proximal end and a distal end, the sprinkler being configured for the fire protection of an occupancy classified as any one of: light hazard, ordinary hazard, extra hazard, rack storage with solid shelves and any combination thereof, the sprinkler comprising:

a body having an inlet and an outlet spaced from the inlet to define a passageway to further define a sprinkler axis and a K factor ranging from about 11 gpm/(psi)$^{1/2}$ to about 25 gpm/(psi)$^{1/2}$; and a deflector distally spaced from the outlet to distribute a fire fighting fluid over a maximum protection area of about 196 square feet, the deflector being configured to throw the fluid radially relative to the axis a minimum distance of about nine feet (9 ft.) such that the fluid travels no more than three feet (3 ft.) in the distal direction parallel to the axis at the nine foot radius, the sprinkler being subject to a minimum operating pressure of about seven pounds per square inch (7 psi.) .);

wherein the deflector defines a peripheral edge and includes a plurality of slots, a portion of the peripheral edge defining a pair of substantially straight parallel portions disposed about the sprinkler axis; and the plurality of slots including slots being disposed between the sprinkler axis and the peripheral edge to define closed ended slots.

3. The sprinkler of claim 1, further comprising a pair of arms diametrically opposed about the body so as to define a plane therebetween, the arms extending distally and converging toward one another so to define an apex therebetween.

4. The sprinkler of claim 1, wherein the deflector includes a plate member having a first surface opposed the outlet of the body, a second surface substantially parallel the first surface, and a central bore extending between the first and the second surface, the central bore engaged with a portion of the body.

5. The sprinkler of claim 4, wherein the first surface includes a pair of spaced apart projections.

6. The sprinkler of claim 4, wherein the pair of substantially straight parallel portions disposed about the sprinkler axis define a spacing between about 1.5 to about 1.75 inches.

7. An extended coverage pendent sprinkler assembly having a proximal end and a distal end, the sprinkler being configured for the fire protection of an occupancy classified as any one of: light hazard, ordinary hazard, extra hazard, rack storage with solid shelves and any combination thereof, the sprinkler comprising:

a body having an inlet and an outlet spaced from the inlet to define a passageway to further define a sprinkler axis and a K factor of about 17 gpm/(psi)$^{1/2}$;

a deflector distally spaced from the outlet to distribute a fire fighting fluid over a maximum protection area of about 196 square feet so as to provide an average density as low as 0.23 gallons per minute per square foot (gpm/sq. ft.);

wherein the deflector includes a plate member having a first surface opposed the outlet of the body, a second surface substantially parallel the first surface, and a central bore extending between the first and the second surface, the central bore engaged with a portion of the body;

wherein the deflector defines a peripheral edge, a portion of the peripheral edge defining a pair of substantially straight parallel portions disposed about the sprinkler axis; and wherein the pair of substantially straight parallel portions define a spacing therebetween ranging between about 1.5 to about 1.75 inches.

8. The sprinkler of claim 7, wherein the deflector defines a maximum width of about 1.6 inches.

9. The sprinkler of claim 7, wherein the pair of substantially straight parallel portions define a spacing therebetween of about 1.6 inches.

10. The sprinkler of claim 5, wherein the pair of spaced apart projections define a spacing therebetween of about 1.6 inches.

11. The sprinkler of claim 1, wherein the body includes a pair of spaced apart arms depending therefrom to define a plane therebetween, the substantially straight edges extending in a direction perpendicular to the plane.

12. The sprinkler of claim 2, wherein the body includes a pair of spaced apart arms depending therefrom to define a plane therebetween, the substantially straight edges extending in a direction parallel to the plane.

13. The sprinkler of claim 4, wherein the plurality of slots, include slots having a first end and a second end spaced from the first end along a slot axis so as to define a slot length, wherein further at least a portion of the plurality of slots have the first end radially disposed between the central bore and the peripheral edge, the second ends of the portion of the plurality of slots being coterminous with the peripheral edge so as to define open ended slots.

14. An extended coverage pendent sprinkler assembly having a proximal end and a distal end, the sprinkler being configured for the fire protection of an occupancy classified as any one of: light hazard, ordinary hazard, extra hazard, rack storage with solid shelves and any combination thereof, the sprinkler comprising:

a body having an inlet and an outlet spaced from the inlet to define a passageway to further define a sprinkler axis and a K factor of about 17 gpm/(psi)$^{1/2}$;

a deflector distally spaced from the outlet to distribute a fire fighting fluid over a maximum protection area of about 196 square feet so as to provide an average density as low as 0.23 gallons per minute per square foot (gpm/sq. ft.);

wherein the deflector includes a plate member having a first surface opposed the outlet of the body, a second surface parallel the first, and a central bore extending between the first and the second surface, the central bore engaged with a portion of the body;

wherein the deflector defines a peripheral edge and includes a plurality of slots, each slot including a first end and a second end spaced from the first end along a slot axis so as to define a slot length, wherein further at least a portion of the plurality of slots have the first end radially disposed between the central bore and the peripheral edge, the second ends of the portion of the plurality of slots being coterminous with the peripheral edge so as to define open ended slots; and wherein the open ended slots define a first set in the plurality of slots, the plurality of slots including a second set of slots, the first ends and the second ends of the second set of slots being disposed between the central bore and the peripheral edge to define closed ended slots.

15. The sprinkler of claim 14, wherein the body includes a pair of spaced apart arms depending from the body and defining a plane therebetween, at least two of the second set of slots being disposed about the plane along a line extending substantially perpendicular to the plane.

16. The sprinkler of claim 15, wherein each of the at least two slots is disposed between two slots of the first set, the two slots of the first set being of substantially the same slot length and defining the smallest slot length of the deflector.

17. The sprinkler of claim 14, wherein the first set of slots define variable slot lengths ranging such that the first ends of the first set of slots is radially disposed from the sprinkler axis at a distance ranging from about 0.5 inches to about 0.40 inches.

18. The sprinkler of claim 17, wherein the first set of slots include slots having a first end radially disposed from the sprinkler axis at about 0.04 inches.

19. The sprinkler of claim 13, wherein the plurality of slots are equiradially disposed about the central bore, the plurality of slots including a first diametrically opposed pair of slots and a second diametrically opposed pair of slots perpendicular to the first pair, the slot axes of the first diametrically opposed pair of slots and the slot axes of the second pair of slots defining a quarter of the deflector therebetween.

20. The sprinkler of claim 19, wherein the quarter of the deflector includes a curved profile defining at least one radius of curvature having a center point located at a distance of about 0.2 from the slot axes of the first pair of diametrically opposed slot axes and about 0.25 from the second pair of diametrically opposed slot axes.

21. The sprinkler of claim 19, wherein the quarter of the deflector includes a curved profile defining at least a second radius of curvature having a center point located at a distance of about 0.2 inches from the slot axes of the first pair of diametrically opposed slot axes and about 0.25 inches from the second pair of diametrically opposed slot axes.

22. The sprinkler of claim 19, wherein the plurality of slots are radially spaced from one another such that the slot axes define an angle of about 22° therebetween.

23. The sprinkler of claim 13, wherein a central portion of the second surface is disposed in a first plane, and a peripheral portion of the second surface about the central portion is disposed in a second plane angled relative the first plane, the angle between the first and the second plane being about 6° .

24. The sprinkler of claim 23, wherein the second surface includes an intermediate portion disposed between the central portion and the peripheral portion, the intermediate portion being disposed in a third plane relative to the first plane, the angle between the third and the first plane being about 13° .

25. The sprinkler of claim 13, wherein each of the plurality of slots includes a pair of spaced apart walls disposed about the slot axes extending between the first end and the second end of the slots to define a slot width therebetween, wherein at least a portion of the plurality of slots have the same slot width.

26. The sprinkler of claim 25, wherein the slot width ranges between about 0.05 inches to about 0.1 inches.

27. The sprinkler of claim 26, wherein the slot width is about 0.08 inches.

28. An extended coverage sprinkler system comprising:

an occupancy defining a protection area of at least 196 square feet and at least one of:

(i) a classification of light hazard, ordinary hazard, extra hazard or a combination thereof and;

(ii) rack storage having including solid shelves;

a fire fighting fluid supply; and a pendent sprinkler configured to provide extended coverage fire protection to the occupancy, the sprinkler including:

a body having an inlet and an outlet defining a passage therebetween, the inlet being in communication with the fluid supply such that the fluid supply provides a minimum operating pressure to the sprinkler of about 7 psi;

a sealing assembly disposed in the outlet including a thermally sensitive trigger to prevent discharge of fluid from the outlet; and a deflector disposed distally of the outlet and above the protection area, wherein when the thermally sensitive trigger actuates, the sealing assembly is displaced from the outlet such that the fluid is discharged from the outlet to impact the deflector, the deflector deflecting the fluid so as to deliver an average density as low as 0.23 gpm/sq. ft. to the protection area, the deflector defining a plurality of tines disposed substantially perpendicular to the sprinkler axis;

wherein the deflector defines a peripheral edge and includes a plurality of slots, a portion of the peripheral edge defining a pair of substantially straight parallel portions disposed about the sprinkler axis; and the plurality of slots including slots being disposed between the sprinkler axis and the peripheral edge to define closed ended slots.

29. A pendent sprinkler assembly having a proximal end and a distal end, the sprinkler comprising:

a body having an inlet and an outlet spaced from the inlet to define a passageway to further define a sprinkler axis and a K factor ranging from about 11 gpm/(psi)$^{1/2}$ to about 25 gpm/(psi)$^{1/2}$;

a pair of arms diametrically opposed about the body so as to define a plane therebetween, the arms extending distally and converging toward one another so to define an apex therebetween;

a deflector distally spaced from the outlet includes a plate member defining a peripheral edge, the deflector having:

a first surface opposed the outlet of the body including a pair of spaced apart projections;

a second surface substantially parallel the first surface; and a central bore extending between the first and the second surface and engaged with a portion of the body, wherein the second surface has a central portion disposed in a first plane and a peripheral portion about the central portion disposed in a second plane angled relative the first plane, the angle between the first and the second plane being about 6° ; wherein the second surface includes an intermediate portion disposed between the central portion and the peripheral portion, the intermediate portion being disposed in a third plane relative to the first plane, the angle between the third and the first plane being about 13° ; and the peripheral edge having a portion defining a pair of substantially straight parallel portions disposed about the sprinkler axis extending in a direction perpendicular to the plane of the arms, the pair of substantially straight parallel portions define a spacing therebetween ranging between about 1.5 to about 1.75 inches, wherein further the peripheral edge further includes a plurality of slots, each slot including a first end and a second end spaced from the first end along a slot axis so as to define a slot length, wherein further at least a portion of the plurality of slots have the first end radially disposed between the central bore and the peripheral edge, the second ends of the portion of the plurality of slots being coterminous with the peripheral edge so as to define open ended slots, the open ended slots defining a first set in the plurality of slots and the plurality of slots including a second set of slots, the first ends and the second ends of the second set of slots being disposed between the central bore and the peripheral edge to define closed ended slots, at least two of the second set of slots being disposed about the plane of the arms along a line extending substantially perpendicular to the plane, wherein each of the at least two of the second set of slots is disposed between two slots of the first set being of substantially the same slot length and defining the smallest slot length of the deflector, the first set of slots further defining variable slot lengths such that the first ends of the first set of slots are radially disposed from the sprinkler axis at distance ranging from about 0.5 inches to about 0.40 inches.

30. A system for protection of high roof buildings and non-storage occupancies having a floor to ceiling clearance ranging from about thirty-six feet to about sixty-five feet, the system comprising:

the sprinkler of claim 29 depending from the ceiling so as to locate the deflector at a height of about sixty to about sixty-five feet from the floor.

* * * * *